United States Patent [19]

Perkins

[11] 4,087,767

[45] May 2, 1978

[54] L-TYPE MATCHING PAD FOR COAXIAL LINES

[75] Inventor: Jack Kenneth Perkins, Ipswich, England

[73] Assignee: The Post Office, London, England

[21] Appl. No.: 716,443

[22] Filed: Aug. 23, 1976

[30] Foreign Application Priority Data

Sep. 3, 1975 United Kingdom ..... 36358/75

[51] Int. Cl.[2] ..... H01P 5/02

[52] U.S. Cl. ..... 333/33; 333/97 R

[58] Field of Search ..... 333/33, 32, 81 A, 97 R; 338/216

[56] References Cited

U.S. PATENT DOCUMENTS

| | | | |
|---|---|---|---|
| 2,994,049 | 7/1961 | Weinschel | 333/97 R X |
| 3,019,402 | 1/1962 | Lanctot | 333/97 R X |
| 3,187,276 | 6/1965 | Walker | 333/33 X |

*Primary Examiner*—Paul L. Gensler

*Attorney, Agent, or Firm*—Kemon & Estabrook

[57] ABSTRACT

A matching pad for connecting coaxial transmission lines and having a first and a second central conductor, said first central conductor having a cavity in an end thereof adjacent said second central conductor, said first and second central conductors being electrically connected by a first resistor at least partially contained within said cavity.

2 Claims, 1 Drawing Figure

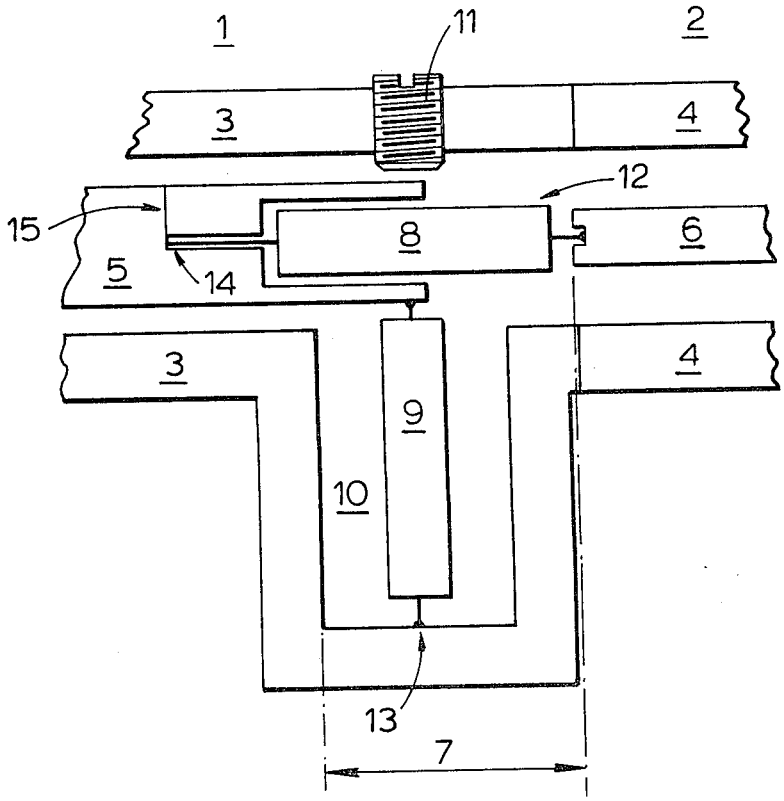
1
11
2
3
4
12
15
8
6
5
14
3
4
9
10
13
7

L-TYPE MATCHING PAD FOR COAXIAL LINES

This invention relates to coaxial transmission lines. In particular, it relates to improvements in the connection of cylindrical coaxial transmission lines of dissimilar dimensions.

It is well-known that transmission lines for the propogation of electrical signals have what is referred to by those skilled in the art as a "characteristic impedance". The characteristic impedance is determined by the dimensions and geometry of the particular transmission line in question.

The characteristic impedance of a transmission line is important when considering the termination of the line. When a line is "matched" by being terminated in an impedance equal to its characteristic impedance no energy is reflected in the opposite direction to the direction of useful transmission. Reflected energy is of course unwanted for two reasons: first it attenuates the signal travelling down the transmission line, and secondly it interferes with the original signal, causing distortion of the signal.

When joining two coaxial transmission lines together, it will, in general, be necessary to terminate each of the lines in its characteristic impedance and, in order to do this, what is known as a matching pad is employed. A matching pad is an arrangement of components, often of resistors alone, which presents to each transmission line terminated by it the correct characteristic impedance.

One commonly used matching pad for jointing coaxial transmission lines is called an L-type matching pad. An L-type matching pad consists of a series resistance electrically connecting the inner conductors of the two coaxial transmission lines to be joined, and a shunt resistance electrically connecting one end of the series resistance to the outer conductor of the matching pad, which is connected to the outer conductor of the coaxial transmission lines.

Unfortunately, conventional matching pads disturb the geometry of the transmission lines to some extent and introduce a discontinuity in the impedance characteristics of the lines; in particular, the distributed impedance of the line becomes discontinuous. There is advantage in reducing the length of the region of disturbed geometry. To some extent this length can be reduced by using smaller resistors, but further reductions of the length of the region of disturbed geometry are still advantageous.

It is one object of the present invention to provide a component arrangement for reducing the length of disturbed geometry in a matching pad joining two coaxial transmission lines of different characteristic impedances.

According to the invention there is provided a matching pad for connecting coaxial transmission lines, and having a first and a second central conductor, said first central conductor having a cavity in an end thereof adjacent said second central conductor, said first and second central conductors being electrically connected by a first resistor at least partially contained within said cavity.

One example of the invention will now be described by way of example, with reference to the accompanying drawing, which shows a cross-section of an L-type matching pad according to the invention. First cylindrical coaxial transmission line 1 comprises a first outer conductor 3 and a first inner conductor 5 and second cylindrical coaxial transmission line 2 comprises second outer conductor 4 and second inner conductor 6. A cavity 12 is formed in the end of said first inner conductor 5 and a series resistance 8 is mounted partially within the cavity 12. Said series resistance 8 is electrically connected as shown to said first and said second inner conductors 5 and 6 respectively. A hole 14 larger that the wire end of the resistor 8 is drilled in the blind end of the cavity 12, parallel with the axis of the conductor and centrally disposed with respect to the cavity. If it is necessary, a pilot hole 15 is drilled perpendicularly to the hole 14 to the outside of the first inner conductor 5 to enable the air in hole 14 to escape as the wire end of the resistor is inserted. Solder is introduced into the hole 14 and the wire end of the resistor 8 is timed. The first inner conductor 5 is then heated and the wire end of the resistor 8 inserted when the solder is molten. A shunt resistance 9 has one end electrically connected to the inner conductor 5 at a central region with respect to the length of said series resistance 8 and has its other end electrically connected to the outer conductor 3. The shunt resistance 9 is provided in a cavity 10 at the junction between the said first and second outer conductors 3 and 4. Said shunt resistance 9 is connected as shown to the wall of said cavity 10 at point 13 and to said first inner conductor 5. A tuning screw 11 is provided for fine adjustment of the electrical characteristics of the cavity 10, and it will be seen that there is a region of disturbed geometry 7 from the inner edge of the recess 10 to the end of the second inner conductor 6.

It will be apreciated that the values of said series and shunt resistances 8 and 9 will be selected for any particular case in order to provide the right matching conditions for said first and said second coaxial transmission lines in a manner similar to a conventional L-type matching pad. To match two transmission lines 1 and 2 in FIG. 1 where the characteristic impedances are respectively $Z_1$ and $Z_2$ the series resistance is given by the equation $$R_A = Z_2\sqrt{1 - \frac{Z_1}{Z_2}} \tag{1}$$

and the shunt resistance $R_B$ is given by the equation $$R_B = \frac{Z_1}{\sqrt{\left(1 - \frac{Z_1}{Z_2}\right)}} \tag{2}$$

In use the size of the cavity 10 would be adjusted by machining, following experimental testing, to provide the optimum performance, and tuning screw 11 provides fine adjustment. In a practical matching pad to join cylindrical coaxial transmission lines having characteristic impedances of 75 and 50 ohms respectively, the series resistance was 43.3 ohms and the shunt resistance was 86.6 ohms.

There are various advantages in reducing the length of the reactive discontinuity, but one of the principal advantages is that a shorter discontinuity reduces the total power reflected back down the transmission line by the discontinuity. A short discontinuity also enables the practical adjustment of the matching pad, for example by machining of the inner and outer conductors over the region of the pad and by machining the recess 10 in FIG. 1 and the adjustment of the tuning screw 11 in FIG. 1, to be made easier. It is easier in that any adjustment will affect the properties in both directions of propagation more nearly equally than would otherwise be the case.

It will be appreciated that, although the embodiment herein described is of a matching pad constructed as an entity with a transmission line, other arrangements are possible. One alternative arrangement is to construct the matching pad outer conductor of a machined brass block upon which are mounted 'back-to-back' two appropriate coaxial connectors.

It will be appreciated that the precise form of the resistor 9 and the cavity 10 are not important; for example a plurality of radially disposed resistors could be used, or an annulus of resistive material could provide a resistive path between the inner and outer conductors.

For ease of assembly, some minor re-arrangement of the pad may be made; in one case where a brass block was used as the body it was split into two parts in the plane of the paper in FIG. 1; screw 11 then was placed in a position at right-angles to its position in FIG. 1, with its central axis in the same plane at right angles to the axis of central conductors.

The other alteration was to move the connection point 13 from the base wall of the cavity 10 to a side of said cavity.

A small screw protruding from the side wall is used to provide a mounting point for the wire tail of the shunt resistor 9.

Other variations in the manufacture of matching pads according to the invention can be made to suit, the particular application and the ease of assembly.

What we claim is:

1. An L-type matching pad for connecting first and second coaxial transmission lines having first and a second central conductors respectively and an outer conductor, a series resistor and a shunt resistor, said first central conductor having a cavity in an end thereof adjacent to said second central conductor, said series resistor electrically connecting said first and second central conductors and being at least partially contained within said cavity, said shunt resistor electrically connecting said first central conductor and said outer conductor, said shunt resistor being situated substantially in the central region of the length of said series resistor.

2. A matching pad as claimed in claim 1, further including means defining a second cavity in said outer conductor and a tuning screw adjustably mounted in said outer conductor for the adjustment of the electrical characteristics of the said second cavity.

* * * * *